US006100020A

United States Patent [19]

Sismondi

[11] Patent Number: 6,100,020

[45] **Date of Patent: *Aug. 8, 2000**

[54] PROCESS FOR THE PREPARATION OF SILVER HALIDE PHOTOGRAPHIC ELEMENT

[75] Inventor: Alain D. Sismondi, Nice, France

[73] Assignee: Eastman Kodak Company, Rochester, N.Y.

[ * ] Notice: This patent is subject to a terminal disclaimer.

[21] Appl. No.: 09/432,678

[22] Filed: Nov. 2, 1999

Related U.S. Application Data

[63] Continuation-in-part of application No. 09/149,330, Sep. 8, 1998, abandoned.

[30] Foreign Application Priority Data

Sep. 19, 1997 [EP] European Pat. Off. ..... 97116341

[51] Int. Cl.[7] ..... G03C 1/00

[52] U.S. Cl. ..... 430/569; 430/567; 430/607; 430/613

[58] Field of Search ..... 430/607, 613, 430/569, 567

[56] References Cited

U.S. PATENT DOCUMENTS

| | | |
|---|---|---|
| 5,028,520 | 7/1991 | Ito . |
| 5,576,170 | 11/1996 | Eikenberry et al. . |
| 5,631,126 | 5/1997 | Daubendiek et al. . |

FOREIGN PATENT DOCUMENTS

| | | |
|---|---|---|
| 0339870 | 11/1989 | European Pat. Off. . |
| 0482599 | 7/1996 | European Pat. Off. . |
| 0488029 | 6/1997 | European Pat. Off. . |
| 0452772 | 7/1997 | European Pat. Off. . |
| 0476521 | 12/1997 | European Pat. Off. . |
| 56-1936 | 1/1981 | Japan . |
| 62-21143 | 1/1987 | Japan . |

OTHER PUBLICATIONS

The Condensed Chemical Dictionary, Tenth Edition, Revised by Gessner G. Hawley, p.90, 1981.

Research Disclosure No. 38957, "Photographic Silver Halide Emulsions, Preparations, Addenda, Systems and Processing," Sep. 1996, pp. 591–639.

*Primary Examiner*—Thorl Chea
*Attorney, Agent, or Firm*—J. Lanny Tucker

[57] ABSTRACT

The present invention relates to a process for the manufacturing of a silver halide element comprising a silver halide emulsion-making step, a chemical or optical sensitization step, and a silver halide emulsion coating step, characterized in that the process comprises the step of adding to the silver halide emulsion, after the chemical or optical sensitization step and before the coating step, an aryl compound having at least two substituents each of these represented by an hydroxyl group and/or a sulfonic group in an amount of less than 0.03 moles per mole of silver. The aryl compound increases the speed to Dmin ratio when used in a silver halide element.

8 Claims, No Drawings

PROCESS FOR THE PREPARATION OF SILVER HALIDE PHOTOGRAPHIC ELEMENT

This is a Continuation-in-Part of U.S. Ser. No. 09/149,330 filed Sep. 8, 1998, now abandoned.

FIELD OF THE INVENTION

The present invention relates to a process for the preparation of a silver halide photographic element. In particular, the present invention relates to the use of an aryl derivative in a process for preparing a silver halide emulsion to improve the speed to Dmin ratio of the resulting photographic material.

BACKGROUND OF THE INVENTION

Silver halide emulsions are usually prepared by precipitating silver halide (silver bromide, silver iodide, silver chloride or mixture thereof) in the presence of a hydrophilic colloid (normally gelatin).

Afterwards, the silver halide emulsions are subjected to a sensitization process for increasing their sensitivity to light. There are two primary types of sensitization processes: spectral sensitization and chemical sensitization.

Spectral sensitization comprises the addition of spectral sensitizing dyes which are adsorbed on the silver halide grain surface to make the emulsion sensitive to the imaging radiation or emitted radiation (i.e., visible or infrared radiation).

Chemical sensitization involves the addition of various chemical substances to obtain a prescribed value of sensitivity and contrast. Typical methods for chemical sensitizing a silver halide photographic emulsion include sulfur sensitization, noble metal sensitization, and reduction sensitization. It is also common in the art to have combination methods, such as sulfur-noble metal sensitization, reduction-noble metal sensitization, and the like.

A number of patents and patent applications, as well as literature references disclose specific methods to improve chemical sensitization. See i.e., *Research Disclosure,* September 1994, Item 36544, Paragraph IV, pp. 510–511, which gives a wide array of references for each of the above-mentioned methods.

Additionally, a wide range of metals have been used as doping agents during emulsion making of silver halide emulsions to modify grain structure and properties. A general review of the use of these doping agents can be found in *Research Disclosure,* September 1994, Item 36544, Paragraph II.D.3, pp. 504–505.

Some recent patents and patent applications teach the use of some metals during chemical sensitization alone or in combination with the above-mentioned conventional method.

For example, EP 467,106 discloses a silver halide photographic element chemically sensitized by gold and sulfur compounds and further by a mercury compound.

JP 04-009,034 discloses silver halide photographic element chemically sensitized by gold in the presence of an iridium or platinum complex salt.

JP 04-009,837 discloses silver halide photographic element chemically sensitized by reduction sensitization and further by a palladium compound.

EP 476,345 discloses silver halide photographic element chemically sensitized in the presence of a noble metal, a sulfur sensitizer, a selenium compound and a silver halide solvent.

JP 04-051,232 discloses silver halide photographic element chemically sensitized in the presence of a gold compound, an iridium compound, and a Group VIII metal compound.

JP 05-045,768 discloses silver halide photographic element chemically sensitized in the presence of a tellurium organic compound and a gold compound. JP 05-053,234 further discloses the possibility of an additional reduction sensitization.

JP 05-045,769 discloses silver halide photographic element chemically sensitized in the presence of tellurium, sulfur and noble metal organic compounds.

JP 04-335640, 05-027,360, 05-027,388, EP 563,708 and EP 638,840 disclose silver halide photographic element chemically sensitized in the presence of selenium, gold and sulfur sensitizer.

EP 568,092 discloses silver halide photographic element chemically sensitized in the presence of a heavy metal and a thiourea compound.

JP 06-051,418 discloses silver halide photographic element chemically sensitized in the presence of a mercuric chloride organic derivative, sodium thiocyanate, sodium thiosulfate, and potassium chloroaurate.

However, all sensitization methods that provide substantial increase of sensitivity are disadvantageous in that although high sensitivity is obtained, fog is also increased, particularly with tabular emulsions.

Additionally, photographic properties are generally altered when the material is subjected to different stressed conditions like rapid drying during manufacture, elevated temperature during storage, high temperature or roller pressure during processing in automatic machines.

After the sensitization process, the silver halide emulsion is coated on a support together with coating additives. A wide description of useful coating aids can be found in *Research Disclosure* No. 38597, September 1996, "Photographic Silver Halide Emulsions, Preparations, Addenda, Systems and Processing", Item IX.

U.S. Pat. No. 5,028,520 discloses the use of hydroquinone sulfonic acid potassium salt on tabular silver halide emulsion in an amount of from 0.03 to 0.5 moles per mole of silver to decrease the surface glossiness. The reference also states that no effect is obtained with an amount lower than 0.03 mole per mole of silver.

JP 54-040729, JP 56-001936 and JP 62-021143 disclose the use of polyhydroxybenzene derivatives on cubic silver halide emulsions to decrease pressure sensitivity in graphic art films.

EP 452772, EP 476521, EP 482599 and EP 488029 disclose the use of polyhydroxybenzene derivatives with functional groups that allow better silver halide grain adsorption to decrease pressure sensitivity of final film.

EP 339870 discloses a silver halide photographic emulsion having in reactive association a sensitizing amount of polyalkylene glycol compound and a fog reducing amount of an arylhydroxy compound.

The object of the invention is to prevent the above mentioned drawback and provide a silver halide emulsion with higher speed to Dmin ratio and enhanced film storability.

SUMMARY OF THE INVENTION

The present invention provides a process for manufacturing a silver halide photographic material comprising: (a) a silver halide emulsion-making step to prepare a silver halide emulsion, (b) a chemical or optical sensitization step, and (c) a coating step, the method further comprising the step of adding an aryl compound having at least two substituents, each of which is represented by an hydroxyl group or a sulfonic group, in an amount less than 0.03 moles per mole of silver to the silver halide emulsion after the chemical or optical sensitization step and before the coating step, provided that when the aryl compound is a 1,2-dihydroxybenzene compound, it further comprises at least one additional substituent other than a sulfo group, and further provided that the silver halide emulsion contains no alkynylamine compound and no polyalkylene glycol.

In another embodiment of the present invention, a silver halide photographic material is provided comprising a support base having coated thereon at least one silver halide emulsion layer, wherein said silver halide emulsion layer comprises an aryl compound having at least two substituents each of which is represented by an hydroxyl group or a sulfonic group in an amount less than 0.03 moles per mole of silver, provided that when the aryl compound is a 1,2-dihydroxybenzene compound, it further comprises at least one additional substituent other than a sulfo group, and further provided that the silver halide emulsion contains no alkynylamine compound and no polyalkylene glycol.

The addition of the aryl compound improves the speed to Dmin ratio of a silver halide photographic emulsion.

DETAILED DESCRIPTION OF THE INVENTION

In the manufacturing of silver halide elements, the following process steps are typically employed: an emulsion-making step, a chemical or optical sensitization step, and a coating step.

Silver Halide Emulsion-making Step

The silver halide emulsion-making step generally includes (i) a nucleation step, where silver halide grain seeds are formed, (ii) one or more growing steps, where the grain seeds achieve their final dimension, and (iii) a washing step, where all soluble salts are removed from the final emulsion. In addition, a ripening step is performed between the nucleation and growing step and/or between the growing and the washing steps.

Silver halide emulsions can be prepared using a singlejet method, a double-jet method, or a combination of these methods and can be ripened using, for example, an ammonia method, a neutralization method, or an acid method. Various parameters may be adjusted to control grain growth such as, pH, pAg, temperature, shape and size of reaction vessel, and the reaction method (e.g., accelerated or constant flow rate precipitation, interrupted precipitation, ultrafiltration during precipitation, reverse mixing processes and combinations thereof). A silver halide solvent, such as ammonia, thioethers, thioureas, etc., may be used, if desired, for controlling grain size, grain structure, particle size distribution of the grains, and the grain-growth rate. The following references provide useful guidance: Trivelli and Smith, *The Photographic Journal,* Vol. LXXIX, May 1939, pp. 330–338; T. H. James, *The Theory of The Photographic Process,* 4th Edition, Chapter 3; *Chimie et Physique Photographique,* P. Glafkides, Paul Montel (1967); *Photographic Emulsion Chemistry,* G. F. Duffin, The Focal Press (1966); *Making and Coating Photographic Emulsions,* V. L. Zelikman, The Focal Press (1966); U.S. Pat. Nos. 2,222,264; 2,592,250; 3,650,757; 3,917,485; 3,790,387; 3,716,276; and 3,979,213; and *Research Disclosure,* September 1994, Item 36544 "Photographic Silver Halide Emulsions, Preparations, Addenda, Systems and Processing."

In the preparation of silver halide emulsions, commonly used halogen compositions of the silver halide grains can be used. Suitable silver halides include silver chloride, silver bromide, silver iodide, silver chloroiodide, silver bromoiodide, silver chlorobromoiodide and the like. However, silver bromide and silver bromoiodide are preferred silver halide compositions with silver bromoiodide compositions containing from 0 to 10 mol % silver iodide, preferably, from 0.2 to 5 mol % silver iodide, and more preferably, from 0.5 to 1.5 mol % silver iodide. The halogen composition of individual grains may be homogeneous or heterogeneous.

As a binder for silver halide emulsions, gelatin is preferred, but other hydrophilic colloids can be used, alone or in combination, such as, dextran, cellulose derivatives (e.g., hydroxyethylcellulose, carboxymethyl cellulose), collagen derivatives, colloidal albumin or casein, polysaccharides, synthetic hydrophilic polymers (e.g., polyvinylpyrrolidone, polyacrylamide, polyvinylalcohol, polyvinylpyrazole) and the like. Gelatin derivatives, such as, highly deionized gelatin, acetylated gelatin and phthalated gelatin can also be used. It is also common to employ the hydrophilic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like.

The grains of these silver halide emulsions may be coarse or fine, and the grain size distribution may be narrow or broad. In addition, the silver halide grains may be regular grains having a regular crystal structure such as cube, octahedron, and tetradecahedron, or the spherical or irregular crystal structure, or those having crystal defects such as twin planes, or those having a tabular form, or combinations thereof. Furthermore, the grain structure of the silver halides may be uniform from the interior to exterior thereof, or be multilayer. In a simple embodiment, the grains may comprise a core and a shell, which may have different halide compositions and/or may have undergone different modifications such as the addition of doping agents. Besides having a differently composed core and shell, the silver halide grains may also comprise different phases in-between. Additionally, the silver halides may be of the type that allows a latent image to be formed mainly on the surface thereof or the type that allows it to be formed inside the grains thereof.

Preferably, tabular silver halide emulsions are used having an aspect ratio of at least 2:1, preferably, 2:1 to 20:1, more preferably, 2:1 to 14:1, and most preferably, 2:1 to 8:1. As used herein, aspect ratio refers to the average diameter:thickness ratio of silver halide grains. Average diameters of the tabular silver halide grains range from about 0.3 to about 5 $\mu$m, preferably, from about 0.5 to about 3 $\mu$m, more preferably, from about 0.8 to about 1.5 $\mu$m. Suitable tabular silver halide grains have a thickness of less than 0.4 $\mu$m, preferably, less than 0.3 $\mu$m, and more preferably, within 0.1 to 0.3 $\mu$m. The projected area of the tabular silver halide grains should account for at least 50%, preferably, at least 80%, and more preferably, at least 90% of the projected area of all the silver halide grains of the emulsion.

The tabular silver halide grain dimensions and characteristics described above can be readily ascertained by procedures well known to those skilled in the art. As used herein, the term "diameter" is defined as the diameter of a circle having an area equal to the projected area of the grain. The term "thickness" refers to the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the method used, the average diameter:thickness ratios obtained do not greatly differ.

Silver halide emulsions containing tabular silver halide grains can be prepared by various processes known to those of ordinary skill in the art for the preparation of photographic elements.

Preparation of silver halide emulsions containing tabular silver halide grains is described in, for example, de Cugnac and Chateau, "Evolution of the Morphology of Silver Bromide Crystals During Physical Ripening", *Science and Industries Photographiques,* Vol. 33, No.2 (1962), pp.121–125; Gutoff, "Nucleation and Growth Rates During the Precipitation of Silver Halide Photographic Emulsions", *Photographic Science and Engineering,* Vol. 14, No. 4 (1970), pp. 248–257; Berry et al., "Effects of Environment on the Growth of Silver Bromide Microcrystals", Vol.5, No.6 (1961), pp. 332–336; *Research Disclosure,* September 1994, Item 36544 "Photographic Silver Halide Emulsions, Preparations, Addenda, Systems and Processing"; U.S. Pat. Nos. 4,063,951; 4,067,739; 4,184,878; 4,434,226; 4,414,310; 4,386,156; and 4,414,306; and EP Publication 263,508.

At the end of the silver halide grain formation, water-soluble salts are removed from the emulsion by procedures known in the art. Suitable washing processes are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

Among the known techniques for removing the dispersing medium and soluble salts while retaining silver halide grains in the remaining dispersion, ultrafiltration is a particularly advantageous washing processes for the practice of this process. Typically, an ultrafiltration unit comprising membranes of inert, non-ionic polymers is used as a washing process. Since silver halide grains are large in comparison with the dispersing medium and the soluble salts or ions, silver halide grains are retained by the membranes while the dispersing medium and the soluble salts dissolved therein are removed.

Chemical or Optical Sensitization Step

Prior to use, silver halide grain emulsions are generally fully dispersed and bulked up with gelatin or other dispersion of peptizer and subjected to any of the known methods for achieving optimum sensitivity. A wide description of methods and compounds useful in chemical or optical sensitization can be found in Research Disclosure No. 38597, September 1996, "Photographic Silver Halide Emulsions, Preparations, Addenda, Systems and Processing", Items IV and 5.

Chemical sensitization is performed by adding chemical sensitizers and other additional compounds to the silver halide emulsion, followed by the so-called chemical ripening at high temperature for a predetermined period of time. Chemical sensitization can be performed by various chemical sensitizers such as gold, sulfur, reducing agents, platinum, selenium, sulfur plus gold, and the like. Tabular silver halide grains, after grain formation and desalting, are preferably chemically sensitized by at least one gold sensitizer and at least one sulfur sensitizer. During chemical sensitization other compounds can be added to improve the photographic performances of the resulting silver halide emulsion, such as, for example, antifoggants, stabilizers, optical sensitizers, supersensitizers, and the like.

Gold sensitization is performed by adding a gold sensitizer to the emulsion and stirring the emulsion at high temperature of preferably 40° C. or more for a predetermined period of time. As a gold sensitizer, any gold compound that has an oxidation number of +1 or +3 and is normally used as gold sensitizer can be used. Preferred examples of gold sensitizers are chloroauric acid, the salts thereof and gold complexes, such as those described in U.S. Pat. No. 2,399,083. Specific examples of gold sensitizers include chloroauric acid, potassium chloroaurate, auric trichloride, sodium aurithiosulfate, potassium aurithiocyanate, potassium iodoaurate, tetracyanoauric acid, 2-aurosulfobenzothiazole methochloride and ammonium aurothiocyanate.

Sulfur sensitization is performed by adding a sulfur sensitizer to the silver halide emulsion and stirring the emulsion at a high temperature of 40° C. or more for a predetermined period of time. Useful examples of sulfur sensitizer include thiosulfonates, thiocyanates, sulfinates, thioethers, and elemental sulfur.

The amounts of the gold sensitizer and the sulfur sensitizer change in accordance with the various conditions, such as activity of the gold and sulfur sensitizer, type and size of silver halide grains, temperature, pH and time of chemical ripening. These amounts, however, are preferably from 1 to 20 mg of gold sensitizer per mole of silver, and from 1 to 100 mg of sulfur sensitizer per mole of silver. The temperature of chemical ripening is preferably 45° C. or more, and more preferably 50° C. to 80° C. The pAg and pH may take arbitrary values.

During chemical sensitization, times and order of addition of the gold sensitizer and sulfur sensitizer are not particularly limiting. For example, gold and sulfur sensitizers can be added at the initial stage of chemical sensitization or at a later stage either simultaneously or at different times. Usually, gold and sulfur sensitizers are added to the silver halide emulsion by their solutions in water, in a water-miscible organic solvent, such as methanol, ethanol and acetone, or as a mixture thereof.

A stabilizer is preferably added at any time before the addition of the sulfur sensitizer. Even if the action of the stabilizer is not yet fully understood, it is believed that it acts as a digest stabilizer and a site director for the sulfur sensitizer. Preferably, the stabilizer is added before the addition of sulfur chemical sensitizer in an amount of from 1 to 500 milligrams per mole of silver, preferably, from 10 to 300 milligrams per mole of silver.

Specific examples of useful stabilizers include thiazole derivatives; benzothiazole derivatives; mercapto-substituted heterocyclic compounds, such as, for example, mercaptotetrazoles, mercaptotriazoles, mercaptodiazoles, mercaptopyrimidines, mercaptoazoles; azaindenes, such as triazaindenes and tetrazaindenes; triazoles; tetrazoles; and sulfonic and sulfinic benzene derivatives. Azaindenes are preferably used, more preferably, tetraazaindenes.

Moreover, the silver halide grain emulsion may be optically sensitized to a desired region of the visible spectrum. The method for spectral sensitization is not particularly limited. For example, optical sensitization may be possible by using an optical sensitizer, including a cyanine dye, a merocyanine dye, complex cyanine and merocyanine dyes, oxonol dyes, hemioxonol dyes, styryl dyes and streptocyanine dyes, either alone or in combination. Useful optical sensitizers include cyanines derived from quinoline, pyridine, isoquinoline, benzindole, oxazole, thiazole, selenazole, imidazole. Particularly useful optical sensitizers are the dyes of the benzoxazole-, benzimidazole- and benzothiazole-carbocyanine type. Usually, the addition of the spectral sensitizer is performed after the completion of chemical sensitization. Alternatively, spectral sensitization can be performed concurrently with chemical sensitization, can entirely precede chemical sensitization, and can even commence prior to the completion of silver halide precipitation. When the spectral sensitization is performed before the chemical sensitization, it is believed that the preferential absorption of spectral sensitizing dyes on the crystallographic faces of the tabular grains allows chemical sensitization to occur selectively at unlike crystallographic surfaces of the tabular grains. Preferably, the spectral sensitizers produce J aggregates, if adsorbed on the surface of the silver halide grains, and a sharp absorption band (J-band) with a bathochromic shift with respect to the absorption maximum of the free dye in aqueous solution.

It is known in the art of radiographic photographic elements that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of the silver halide grains. Optimum dye concentration levels are chosen in the range of 0.5 to 20 millimoles per mole of silver halide, preferably, in the range of 2 to 10 millimoles.

Spectral sensitizing dyes producing J aggregates are well known in the art, as illustrated by F. M. Hamer, *Cyanine Dyes and Related Compounds,* John Wiley and Sons, 1964, Chapter XVII and by T. H. James, *The Theory of the Photographic Process,* 4th Edition, MacMillan, 1977, Chapter 8.

In a preferred form, J-band exhibiting dyes are cyanine dyes. Such dyes consist of two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

The cyanine dyes, which are joined by a methine linkage, include two basic heterocyclic nuclei, such as pyrrolidine, oxazoline, thiazoline, pyrrole, oxazole, thiazole, selenazole, tetrazole and pyridine and nuclei obtained by fusing an alicyclic hydrocarbon ring or an aromatic hydrocarbon ring to each of the above nuclei, such as indolenine, benzindolenine, indole, benzoxazole, naphthoxazole, benzothiazole, naphthothiazole, benzoselenazole, benzimidazole and quinoline. These nuclei can have substituents groups.

The merocyanine dyes, which are joined by a methine linkage, include a basic heterocyclic nucleus of the type described above and an acid nucleus, such as a 5- or 6-membered heterocyclic nucleus derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1-3-dione, and isoquinolin-4-one.

The preferred dyes are cyanine dyes, such as those represented by the following formula:

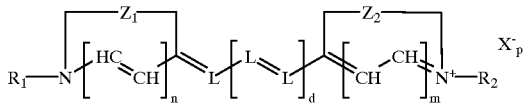

wherein n, m and d each independently represents 0 or 1, L represents a methine linkage, e.g., =CH—, ≡C($C_2H_5$), etc., $R_1$ and $R_2$ each represents a substituted or unsubstituted alkyl group, preferably, a lower alkyl group of from 1 to 4 carbon atoms, e.g., methyl, ethyl, propyl, butyl, cyclohexyl and dodecyl, a hydroxyalkyl group, e.g., β-hydroxyethyl and Ω-hydroxybutyl, an alkoxyalkyl group, e.g., β-methoxyethyl and Ω-butoxyethyl, a carboxyalkyl group, e.g., β-carboxyethyl and Ω-carboxybutyl, a sulfoalkyl group, e.g., β-sulfoethyl and Ω-sulfobutyl, a sulfatoalkyl group, e.g., β-sulfatoethyl and Ω-sulfatobutyl, an acyloxyalkyl group, e.g., β-acetoxyethyl, γ-acetoxypropyl and Ω-butyryloxybutyl, an alkoxycarbonylalkyl group, e.g., β-methoxycarbonylethyl and Ω-ethoxycarbonylbutyl, benzyl, phenethyl, or an aryl group of up to 30 carbon atoms, e.g., phenyl, tolyl, xylyl, chlorophenyl and naphthyl, X represents an acid anion, e.g., chloride, bromide, iodide, thiocyanate, sulfate, perchlorate, p-toluenesulfonate and methylsulfate; the methine linkage forming an intramolecular salt when p is 0; $Z_1$, and $Z_2$, the same or different, each represents the non-metallic atoms necessary to complete the same simple or condensed 5- or 6-membered heterocyclic nucleus, such as a benzothiazole nucleus (e.g., benzothiazole, 3-, 5-, 6- or 7-chloro-benzothiazole, 4-, 5- or 6-methylbenzothiazole, 5- or 6-bromobenzothiazole, 4- or 5-phenyl-benzothiazole, 4-, 5- or 6-methoxybenzothiazole, 5,6-dimethyl-benzothiazole and 5- or 6-hydroxybenzothiazole), a naphthothiazole nucleus (e.g., α-naphthothiazole, β-naphthothiazole, 5-methoxy-β-naphthothiazole, 5-ethoxy-α-naphthothiazole and 8-methoxy-α-naphthothiazole), a benzoselenazole nucleus (e.g., benzoselenazole, 5-chloro-benzoselenazole and tetrahydrobenzoselenazole), a naphthoselenazole nucleus (e.g., α-naphtho-selenazole and β-naphthoselenazole), a benzoxazole nucleus (e.g., benzoxazole, 5- or 6-hydroxybenzoxazole, 5-chloro-benzoxazole, 5- or 6-methoxybenzoxazole, 5-phenyl-benzoxazole and 5,6-dimethylbenzoxazole), a naphthoxazole nucleus (e.g., α-naphthoxazole and β-naphthoxazole), a 2-quinoline nucleus (e.g., 2-quinoline, 6-, 7, or 8-methyl-2-quinoline, 4-, 6- or 8-chloro-2-quinoline, 5-, 6- or 7-ethoxy-2-quinoline and 6- or 7-hydroxy-2-quinoline), a 4-quinoline nucleus (e.g., 4-quinoline, 7- or 8-methyl-4-quinoline and 6-methoxy-4-quinoline), a benzimidazole nucleus (e.g., benzimidazole, 5-chloro-benzimidazole and 5,6-dichloro-benzimidazole), a thiazole nucleus (e.g., 4- or 5-methyl-thiazole, 5-phenyl-thiazole and 4,5-di-methyl-thiazole), an oxazole nucleus (e.g., 4- or 5-methyl-oxazole, 4-phenyl-oxazole, 4-ethyl-oxazole and 4,5-dimethyl-oxazole), and a selenazole nucleus (e.g., 4-methyl-selenazole and 4-phenyl-selenazole. More preferred dyes within the above class are those having an internal salt group and/or derived from benzoxazole and benzimidazole nuclei as indicated before. Typical methine spectral sensitizing dyes include those listed below.

Dye A

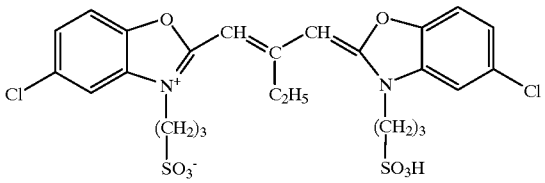

Dye B

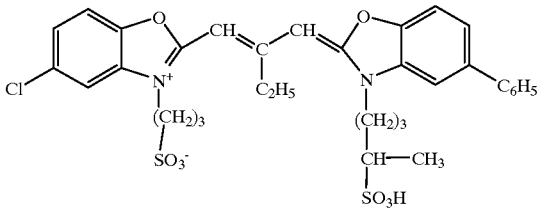

Dye C

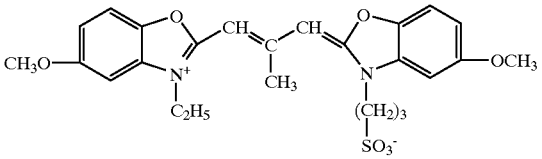

Dye D

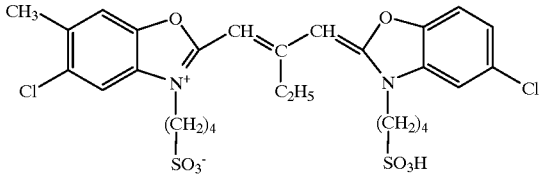

Dye E

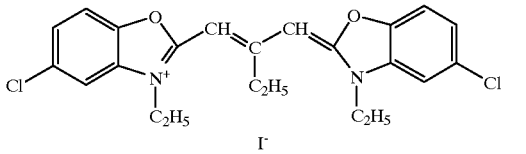

Dye F

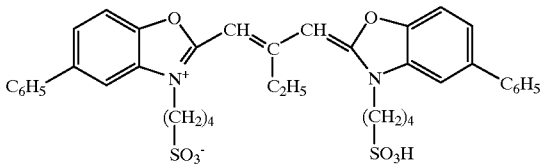

-continued

Dye G

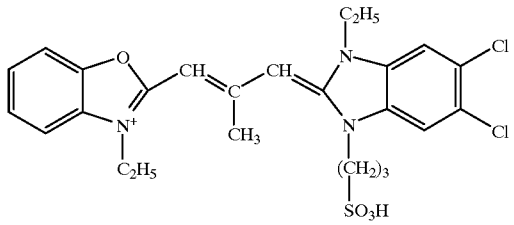

The methine spectral sensitizing dyes are generally known in the art. Particular reference can be made to U.S. Pat. Nos. 2,503,776; 2,912,329; 3,148,187; 3,397,060; 3,573,916; and 3,822,136 and French Patent Publication 1,118,778. Also their use in photographic emulsions is very well known wherein they are used in optimum concentrations corresponding to desired values of sensitivity to fog ratios. Optimum or near optimum concentrations of spectral sensitizing dyes generally go from 10 to 500 mg per mole of silver, preferably, from 50 to 200, and more preferably, from 50 to 100.

Spectral sensitizing dyes can be used in combinations which result in supersensitization, i.e., spectral sensitization which is greater in a spectral region than that from any concentration of one dye alone or which would result from an additive effect of the dyes. Supersensitization can be obtained with selected combinations of spectral sensitizing dyes and other addenda, such as stabilizers and antifoggants, development accelerators and inhibitors, optical brighteners, surfactants and antistatic agents, as described by Gilman, *Photographic Science and Engineering,* 18, pp. 418–430, 1974 and in U.S. Pat. Nos. 2,933,390; 3,635,721; 3,743,510; 3,615,613; 3,615,641; 3,617,295; and 3,635,721.

Coating Step

The resulting silver halide emulsion is then coated on a suitable support or substrate to prepare a silver halide photographic material.

Prior to the coating step, and after the chemical or optical sensistization step described above, an aryl compound is added to the silver halide emulsion. This aryl compound has at least two substituents each of which is represented by an hydroxyl group or a sulfonic group is added to the silver halide emulsion in an amount of less than 0.03 moles per mole of silver before the coating of the silver halide emulsion. However, when the aryl compound is a 1,2-dihydroxybenzene, it has at least one other substituent on the benzene ring that is not a sulfo group.

Preferably, the aryl compound is represented by the following formulas:

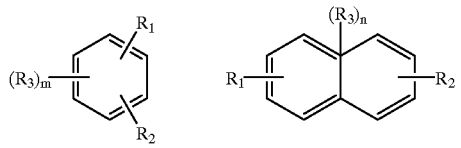

wherein each of $R_1$ and $R_2$ is selected from the group consisting of hydroxyl group and sulfonic group, $R_3$ represents a hydroxyl group, a sulfonic group, a nitro group, a cyano group, an amino group, an alkyl group, an alkylcarboxy group, and a carboxyl group, m is an integer of from 1 to 4, and n is an integer of from 1 to 6.

Useful examples of aryl compounds represented by the above mentioned general formula are listed below.

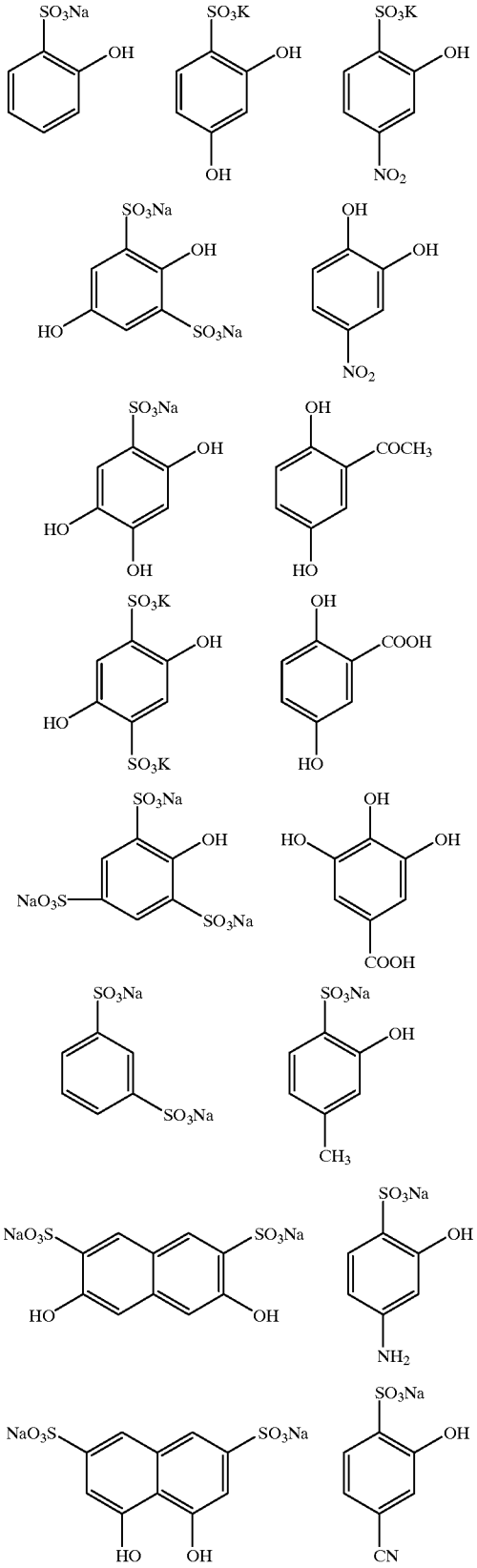

The amount of the above described aryl compound is preferably in the range of from 0.0001 to 0.03 moles per mole of silver, more preferably from 0.001 to 0.03 moles per mole of silver, and most preferably from 0.005 to 0.03 moles per mole of silver.

Other additives can be added to the silver halide emulsion before or during coating, such as, for example, stabilizers or antifoggants such as azaindenes, triazoles, tetrazoles, imidazolium salts and others; developing promoters such as benzyl alcohol, polyoxyethylene type compounds, etc.; image stabilizers such as compounds of the chromane, cumaran, bisphenol type, etc.; and lubricants such as wax, higher fatty acids glycerides, higher alcohol esters of higher fatty acids, etc. may be added. Also, coating aids, modifiers of the permeability in the processing liquids, defoaming agents, antistatic agents and matting agents may be used. Other useful additives are disclosed in *Research Disclosure,* Item 17643, December 1978; *Research Disclosure,* Item 18431, August 1979; *Research Disclosure,* Item 308119, Section IV, December 1989; and *Research Disclosure* Item 36544, September 1994. The silver halide emulsions used in this invention, however, do not include do not contain detectable amounts of alkynylamine compounds such as those described in U.S. Pat. No. 5,576,170 (Eikenberry et al), or polyalkylene glycol sensitizers as described in EP-A-0 339,870 (Sills).

Suitable support materials include glass, paper, polyethylene-coated paper, metals, polymeric film such as cellulose nitrate, cellulose acetate, polystyrene, polyethylene terephthalate, polyethylene, polypropylene and the like.

Preferred light-sensitive silver halide photographic elements are radiographic light-sensitive elements used in X-ray imaging comprising a silver halide emulsion layer(s) coated on both surfaces of a support, preferably, a polyethylene terephthalate support. Preferably, the silver halide emulsions are coated on the support at a silver coverage in the range of 1.5 to 3 g/m$^2$ per side. Usually, the radiographic light-sensitive elements are associated with intensifying screens so as to be exposed to radiation emitted by the screens. The screens are made of relatively thick phosphor layers that transform the X-rays into more imaging-effective radiation such as light (e.g., visible light). The screens absorb a larger portion of X-rays than the light-sensitive elements do and are used to reduce the X-ray dose necessary to obtain a useful image. Intensifying screens absorbing more than 25% of the total X-radiation are preferably used. Depending on their chemical composition, the phosphors can emit radiation in the ultraviolet, blue, green or red region of the visible spectrum and the silver halide emulsions are sensitized to the wavelength region of the radiation emitted by the screens. Sensitization is performed by using spectral sensitizing dyes absorbed on the surface of the silver halide grains as described above.

Other layers and additives, such as subbing layers, surfactants, filter dyes, intermediate layers, protective layers, anti-halation layers, barrier layers, dye underlayers, development inhibiting compounds, speed-increasing agents, stabilizers, plasticizers, chemical sensitizers, UV absorbers and the like can be present in the radiographic element. Dye underlayers are particularly useful to reduce the cross-over of the double coated silver halide radiographic element. Reference to well-known dye underlayer can be found in U.S. Pat. Nos. 4,900,652; 4,855,221; 4,857,446; and 4,803,150. Preferably, a dye underlayer is coated on at least one side of the support, more preferably, on both sides of the support, before the coating of at least two silver halide emulsion.

The silver halide radiographic elements are preferably fore-hardened. Typical examples of organic or inorganic hardeners include chrome salts (e.g., chrome alum, chromium acetate), aldehydes (e.g., formaldehyde and glutaraldehyde), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy-substituted vinylsulfonyl derivatives) and the like. Other references to well known hardeners can be found in *Research Disclosure,* December 1989, Vol. 308, Item 308119, Section X; and *Research Disclosure,* September 1994, Vol. 365, Item 36544, Section II(b). A detailed description of photographic elements and of various layers and additives may be found in *Research Disclosure* 17643 December 1978; *Research Disclosure* 18431 August 1979; *Research Disclosure* 18716 November 1979; *Research Disclosure* 22534 January 1983; *Research Disclosure* 308119 December 1989; and *Research Disclosure* 36544, September 1994. The silver halide photographic element can be exposed and processed by any conventional processing technique. Any known developing agent can be added into the developer, such as, for example, dihydroxybenzenes (e.g., hydroquinone), pyrazolidones (1-phenyl-3-pyrazolidone or 4,4-dimethyl-1-phenyl-3-pyrazolidone), and aminophenols (e.g., N-methyl-p-aminophenol), alone or in combinations thereof. Preferably, the silver halide photographic elements are developed in a developer comprising dihydroxybenzenes as the main developing agent, and pyrazolidones and p-aminophenols as auxiliary developing agents. Other well known additives can be present in the developer, such as, for example, antifoggants (e.g., benzotriazoles, indazoles, tetrazoles), silver halide solvents (e.g., thiosulfates, thiocyanates), sequestering agents (e.g., amino-polycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10. The silver halide photographic element can be processed with a fixer of a typical composition for the application required. Suitable fixing agents include thiosulfates, thiocyanates, sulfites, ammonium salts, and the like. The fixer composition can comprise other well known additives, such as, for example, acid compounds (e.g., metabisulfates), buffers (e.g., carbonic acid, acetic acid), hardeners (e.g., aluminum salts), tone improving agents, and the like.

The exposed radiographic elements can be processed by any of the conventional processing techniques. Such processing techniques are illustrated for example in *Research Disclosure,* Item 17643 (cited above); and *Research Disclosure* 36544, September 1994. Roller transport processing is particularly preferred, as illustrated in U.S. Pat. Nos. 3,025,779; 3,515,556; 3,545,971; and 3,647,459 and UK Patent 1,269,268. Hardening development can also be used, as illustrated in U.S. Pat. No. 3,232,761.

With regard to the processes for the silver halide emulsion preparation and the use of particular ingredients in the emulsion and in the light-sensitive element, reference is made to *Research Disclosure,* September 1996, Item 38957, and particularly to the following chapters:

I. Emulsion grains and their preparation.

II. Vehicles, vehicle extenders, vehicle-like addenda and vehicle related addenda.

III. Emulsion washing.

IV. Chemical sensitization

V. Spectral sensitization and desensitization

VI. UV dyes/optical brighteners/luminescent dyes

VII. Antifoggants and stabilizers

VIII. Absorbing and scattering materials.

IX. Coating physical property modifying addenda.

X. Dye image formers and modifiers.

XI. Layers and layer arrangements

XV. Supports

The present invention will be now described in greater detail with reference to the following not limiting examples. All the amounts referred to in the following examples are relative to one mole of silver in the resulting silver halide emulsion, unless differently specified.

EXAMPLE 1

Sample 1 (control)

A silver bromoiodide emulsion with an average grain equivalent diameter of 1.25 micrometers, an average grain thickness of 0.18 micrometers, a COV of 37% and 0.9 percent iodide in mole respect to the total halide ions was prepared by double jet method.

The emulsion was chemically and spectrally sensitized using sulfur, gold, mercury and palladium sensitizers plus a triethyl ammonium salt of 5,5'-dichloro-9-ethyl-3,3'-di-(3-sulfopropyl) oxacarbocyanine as spectral sensitization dye. The digest was performed about 120 to 130 minutes at 60° C. and stabilized successively with 200 mg of potassium iodide and 1366 mg of 5-methyl-7-hydroxy-2-3 - 4-triazoindolizine (4-hydroxy-6-methyl- 1,3,3a,7-tetraazaindene) before chilling.

The sensitized silver halide emulsion was melted at 45° C. and subjected to coating finals in laboratory. As coating auxiliaries were added 1293 mg of calcium nitrate, 80 mg of azodicarboxylic dimorpholide, 18338 mg of polyethylacrylate (in dispersion at 20% in water plus 367 mg of lauryl sulfate), 66738 mg of dextran (manufactured by Pharmacosmos) as gel extender, 267 mg of Colanyl blue™ (manufactured by Hoechst Chemical Co.) as chromatic corrector. The pH was corrected to 6.3 before adding 3774 mg of SSMA copolymer (Copolymer of Styrene sulfonic acid and maleic anhydride, manufactured by Aquaness Corp., Texas, USA).

The resulting silver halide emulsion was immediately coated on the two faces of blue polyester base code with a conventional antistatic top-coat containing hardening agents. The coating speed was 8.3 meters per minute and the covering weight was around 2.25 g of silver per $m^2$ per side.

The fresh film samples were kept 3 days at 38° C. before being subjected to X-ray exposure using of 75 Kv and 300 mA for 0.06 second with two Trimax™ Medium screens (manufactured by Imation Corp., MN, USA).

The exposed films were processed through a 90 seconds dry to dry medical X-ray automatic processor type XP 515 (manufactured by Imation Corp., MN, USA) with standard chemistry (XAD 3 developer and XAF 3 fixer, both manufactured by Imation Corp., MN, USA).

The sensitometric results are reported in the following Table 1

Sample 2 (Invention)

The procedure of sample 1 was repeated with the same emulsion and the same sensitizing process, except that during addition of coating finals, 7.26 g of compound 1 (4,5-dihydroxy-1,3-benzenedisulfonic acid disodium salt) were added for one mole of silver, corresponding to 0.023 mole of compound by mole of silver and 300 mg of compound per square meter of coated film. The sensitometric results are reported in the following Table 1.

Sample 3 (Invention)

The procedure of sample I was repeated with the same emulsion and the same sensitizing process, except that during addition of coating finals, 5 g of compound 2 (2,5-dihydroxybenzenesulfonic acid potassium salt) were added for one mole of silver, corresponding to 0.0219 mole of compound per mole of silver and 209 mg of compound per square meter of coated film. The sensitometric results are reported in the following Table 1.

Sample 4 (Invention)

The procedure of sample 1 was repeated with the same emulsion and the same sensitizing process, except that during addition of coating finals, 7.55 g of compound 3 (2,5-dihydroxy-1,4-benzenedisulfonic acid dipotassium salt) were added for one mole of silver, corresponding to 0.0218 mole of compound per mole of silver and 315 mg of compound per square meter of coated film. The sensitometric results are reported in the following Table 1.

TABLE 1

| Sample | Compound | Amount (mole/Ag mole) | Dmin | Speed | Ratio * |
|---|---|---|---|---|---|
| 1 | — | — | 0.20 | 100 | 5 |
| 2 | 1 | 0.023 | 0.19 | 92 | 4.84 |
| 3 | 2 | 0.022 | 0.19 | 100 | 5.26 |
| 4 | 3 | 0.022 | 0.19 | 101 | 5.32 |

* The ratio is calculated according to the formula Speed/Dmin * 100

All speed values were measured 0.1 Log E above Dmin and the sensitivity of the control was normalized to 100.

The results of table 1 clearly show that samples 3 and 4 gave a reduction in Dmin without sensitivity loss. Consequently the Speed/Dmin ratio is increased as claimed.

EXAMPLE 2

Samples 5 through 8

The procedure of samples 1 through 4 was repeated with the same emulsion and the same sensitizing process, except that the fresh film samples are kept 3 days at 38° C. plus 11 weeks on aging before being subjected to X-ray exposure. The sensitometric results are reported in the following Table 2.

TABLE 2

| Sample | Compound | Amount (mole/Ag mole) | Dmin | Speed | Ratio * |
|---|---|---|---|---|---|
| 5 (C) | — | — | 0.21 | 100 | 4.76 |
| 6 (I) | 1 | 0.023 | 0.20 | 101 | 5.05 |
| 7 (I) | 2 | 0.022 | 0.20 | 104 | 5.2 |
| 8 (I) | 3 | 0.022 | 0.20 | 107 | 5.35 |

* The ratio is calculated according to the formula Speed/Dmin * 100

The date of Table 2 clearly show that after aging all compounds reduce the increase of Dmin with a slight sensitivity increase. Consequently the Speed/Dmin ratio is substantially increased as claimed.

EXAMPLE 3

Samples 9 through 12

The procedure of samples 1 through 4 was repeated with the same emulsion and the same sensitizing process, except that the fresh film samples are kept 3 days at 38° C. plus 12 weeks aging before being subjected to X-ray exposure. The sensitometric results are reported in the following Table 3.

TABLE 3

| Sample | Compound | Amount (mole/Ag mole) | Dmin | Speed | Ratio * |
|---|---|---|---|---|---|
| 9 (C) | — | — | 0.21 | 100 | 4.76 |
| 10 (I) | 1 | 0.023 | 0.20 | 103 | 5.15 |
| 11 (I) | 2 | 0.022 | 0.20 | 103 | 5.15 |
| 12 (I) | 3 | 0.022 | 0.20 | 110 | 5.50 |

* The ratio is calculated according to the formula Speed/Dmin * 100

The data of Table 3 show that after 12 weeks, all films that contain compounds of invention maintained the beneficial effect described in this invention

EXAMPLE 4

Samples 13 through 16

The procedure of samples 1 through 4 was repeated with the same emulsion and the same sensitizing process, except that the fresh film samples are kept 3 days at 38° C. plus 13 weeks aging before being subjected to X-ray exposure. The sensitometric results are reported in the following Table 4.

TABLE 4

| Sample | Compound | Amount (mole/Ag mole) | Dmin | Speed | Ratio * |
|---|---|---|---|---|---|
| 13 (C) | — | — | 0.21 | 100 | 4.76 |
| 14 (I) | 1 | 0.023 | 0.20 | 108 | 5.40 |
| 15 (I) | 2 | 0.022 | 0.20 | 106 | 5.30 |
| 16 (I) | 3 | 0.022 | 0.20 | 117 | 5.85 |

* The ratio is calculated according to the formula Speed/Dmin * 100

The data of Table 4 clearly show that after 13 weeks, lower Dmin and higher sensitivity were maintained with respect to the control film. This demonstrated the beneficial effect of all compounds described in the present invention to substantially increased the speed to Dmin ratio and to preserve the sensitometric characteristics on aging.

EXAMPLE 5

Sample 17 (control)

The procedure of sample 1 was repeated. The sensitometric results are reported in the following Table 5.

Sample 18 (Invention)

The procedure of sample 17 was repeated except that during addition of coating finals, 1.89 g of compound 3 (2,5-dihydroxy-1,4-benzenedisulfonic acid dipotassium salt) was added for one mole of silver, corresponding to 0.0055 mole of compound per mole of silver and 79 mg of compound per square meter of coated film. The sensitometric results are reported in the following Table 5.

Sample 19 (Invention)

The procedure of sample 17 was repeated except that during addition of coating finals, 3.78 g of compound 3 (2,5-dihydroxy-1,4-benzenedisulfonic acid dipotassium salt) was added for one mole of silver, corresponding to 0.011 mole of compound per mole of silver and 158 mg of compound per square meter of coated film. The sensitometric results are reported in the following Table 5.

Sample 20 (Invention)

The procedure of sample 17 was repeated except that during addition of coating finals, 5.66 g of compound 3 (2,5-dihydroxy-1,4-benzenedisulfonic acid dipotassium salt) was added for one mole of silver, corresponding to 0.0165 mole of compound per mole of silver and 236 mg of compound per square meter of coated film. The sensitometric results are reported in the following Table 5.

Sample 21 (Invention)

The procedure of sample 17 was repeated except that during addition of coating finals, 7.55 g of compound 3 (2,5-dihydroxy-1,4-benzenedisulfonic acid dipotassium salt) was added for one mole of silver, corresponding to 0.0218 mole of compound per mole of silver and 315 mg of compound per square meter of coated film. The sensitometric results are reported in the following Table 5.

TABLE 5

| Sample | Compound | Amount (mole/Ag mole) | Dmin | Speed | Ratio * |
|---|---|---|---|---|---|
| 17 (C) | — | — | 0.21 | 100 | 4.76 |
| 18 (I) | 3 | 0.0055 | 0.20 | 102 | 5.10 |
| 19 (I) | 3 | 0.011 | 0.20 | 101 | 5.05 |
| 20 (I) | 3 | 0.0165 | 0.195 | 105 | 5.38 |
| 21 (I) | 3 | 0.022 | 0.19 | 105 | 5.53 |

* The ratio is calculated according to the formula Speed/Dmin * 100

The data of Table 5 confirms the good results of compound 3, one of those described in the present invention. All amounts of compound 3 between 0.0055 to 0.022 mole per mole of silver were able to increase the speed and to reduce the Dmin, so substantially increasing the speed to Dmin ratio.

EXAMPLE 6

Sample 22 (control)

The procedure of sample 17 was repeated, except that the film sample was additionally kept 5 days at 50° C. before being subjected to X-ray exposure. The sensitometric results are reported in the following Table 6.

Sample 23 (Invention)

The procedure of sample 22 was repeated, except that during addition of coating finals, 1.89 g of compound 3 (2,5-dihydroxy-1,4-benzenedisulfonic acid dipotassium salt) was added for one mole of silver, corresponding to 0.0055 mole of compound per mole of silver and 79 mg of compound per square meter of coated film. The sensitometric results are reported in the following Table 6.

Sample 24 (Invention)

The procedure of sample 22 was repeated, except that during addition of coating finals, 3.78 g of compound 3 (2,5-dihydroxy-1,4-benzenedisulfonic acid dipotassium salt) was added for one mole of silver, corresponding to 0.011 mole of compound per mole of silver and 158 mg of compound per square meter of coated film. The sensitometric results are reported in the following Table 6.

Sample 25 (Invention)

The procedure of sample 22 was repeated, except that during addition of coating finals, 5.66 g of compound 3 (2,5-dihydroxy-1,4-benzenedisulfonic acid dipotassium salt) was added for one mole of silver, corresponding to 0.0165 mole of compound per mole of silver and 236 mg of compound per square meter of coated film. The sensitometric results are reported in the following Table 6.

Sample 26 (Invention)

The procedure of sample 22 was repeated, except that during addition of coating finals, 7.55 g of compound 3 (2,5-dihydroxy-1,4-benzenedisulfonic acid dipotassium salt) was added for one mole of silver, corresponding to 0.0218 mole of compound per mole of silver and 315 mg of compound per square meter of coated film. The sensitometric results are reported in the following Table 6.

TABLE 6

| Sample | Compound | Amount (mole/Ag mole) | Dmin | Speed | Ratio * |
|---|---|---|---|---|---|
| 22 (C) | — | — | 0.21 | 100 | 4.76 |
| 23 (I) | 3 | 0.0055 | 0.20 | 110 | 5.50 |
| 24 (I) | 3 | 0.011 | 0.20 | 114 | 5.70 |
| 25 (I) | 3 | 0.0165 | 0.19 | 111 | 5.55 |
| 26 (I) | 3 | 0.022 | 0.19 | 113 | 5.95 |

* The ratio is calculated according to the formula Speed/Dmin * 100

The data of Table 6 clearly demonstrate that the compound 3 of the present invention is able to maintain stable the Dmin on stressed incubation with a substantial increase of speed, so giving a higher speed to Dmin ratio at a concentration ranging from 0.055 to 0.022 moles per silver mole.

EXAMPLE 7

Sample 27 (control)

The procedure of sample 17 was repeated. The sensitometric results are reported in the following Table 7.

Sample 28 (Invention)

The procedure of sample 27 was repeated, except that during addition of coating finals, 1.73 g of compound 4 (2,5-dihydroxy-1,3-benzenedisulfonic acid disodium salt) was added for one mole of silver, corresponding to 0.0055 mole of compound per mole of silver and 72 mg of compound per square meter of coated film. The sensitometric results are reported in the following Table 7.

Sample 29 (Invention)

The procedure of sample 27 was repeated, except that during addition of coating finals, 3.46 g of compound 4 (2,5-dihydroxy-1,3-benzenedisulfonic acid disodium salt) was added for one mole of silver, corresponding to 0.011 mole of compound per mole of silver and 144 mg of compound per square meter of coated film. The sensitometric results are reported in the following Table 7.

Sample 30 (Invention)

The procedure of sample 27 was repeated, except that during addition of coating finals, 6.92 g of compound 4 (2,5-dihydroxy-1,3-benzenedisulfonic acid disodium salt) was added for one mole of silver, corresponding to 0.022 mole of compound per mole of silver and 288 mg of compound per square meter of coated film. The sensitometric results are reported in the following Table 7.

TABLE 7

| Sample | Compound | Amount (mole/Ag mole) | Dmin | Speed | Ratio * |
|---|---|---|---|---|---|
| 27 (C) | — | — | 0.22 | 100 | 4.55 |
| 28 (I) | 4 | 0.0055 | 0.21 | 105 | 5.00 |
| 29 (I) | 4 | 0.011 | 0.205 | 104 | 5.07 |
| 30 (I) | 4 | 0.022 | 0.20 | 100 | 5.00 |

* The ratio is calculated according to the formula Speed/Dmin * 100

The data of Table 7 clearly show the beneficial effect of compound 4 of the present invention in reducing Dmin and increasing speed for amounts of compound below 0.22 mole per mole of silver.

EXAMPLE 8

Sample 31 (control)

The procedure of sample 1 was repeated. The sensitometric results are reported in the following Table 8.

Samples 32 through 43

The procedure of sample 30 was repeated except that that, during addition of coating finals, 0.022 moles of the compounds of the following Table 8 were added per one mole of silver. The sensitometric results are reported in the following Table 8.

TABLE 8

| | Com- | 3 Days 38° C. | | | 5 Days 50° C. | | |
|---|---|---|---|---|---|---|---|
| Sample | pound | Dmin | Speed | Ratio* | Dmin | Speed | Ratio* |
| 31 | — | 0.201 | 100 | 4.98 | 0.204 | 100 | 4.90 |
| 32 | 3(I) | 0.188 | 106 | 5.64 | 0.187 | 114 | 6.10 |
| 33 | 5(C) | 0.185 | 52 | 2.81 | 0.185 | 31 | 1.68 |
| 34 | 6(C) | n.m. | n.m. | n.m. | n.m. | n.m. | n.m. |
| 35 | 7(I) | 0.184 | 112 | 6.08 | 0.187 | 102 | 5.45 |
| 36 | 8(I) | 0.182 | 101 | 5.55 | 0.182 | 111 | 6.10 |
| 37 | 9(C) | 0.179 | 89 | 4.97 | 0.177 | 100 | 5.65 |
| 38 | 10(I) | 0.181 | 103 | 5.69 | 0.181 | 113 | 6.24 |
| 39 | 11(I) | 0.186 | 106 | 5.70 | 0.185 | 115 | 5.70 |
| 40 | 12(I) | 0.187 | 112 | 5.99 | 0.190 | 114 | 6.00 |
| 41 | 13(C) | 0.193 | 84 | 4.35 | 0.209 | 89 | 4.26 |
| 42 | 14(I) | 0.190 | 110 | 5.79 | 0.191 | 115 | 6.02 |
| 43 | 15(I) | 0.190 | 110 | 5.79 | 0.196 | 120 | 6.12 |

*The ratio is calculated according to the formula Speed/Dmin*100
n.m. = not measurable The data of Table 8 clearly show the good results of the compounds of the present invention in comparison with those outside of the present invention.

The formula of compounds 5 through 15 employed in the above samples can be found in the following Table 9.

TABLE 9

| Compound | Formula |
|---|---|
| 5 | 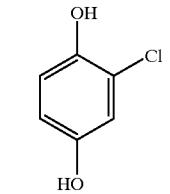 |
| 6 | 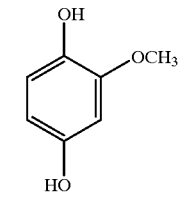 |
| 7 | 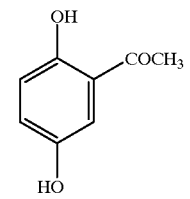 |
| 8 | 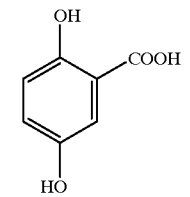 |
| 9 | 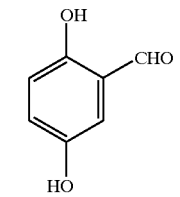 |
| 10 | 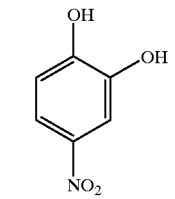 |
| 11 | 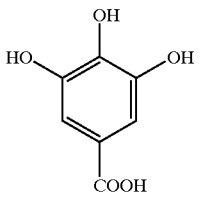 |

TABLE 9-continued

| Compound | Formula |
|---|---|
| 12 | 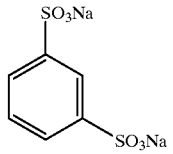 |
| 13 | 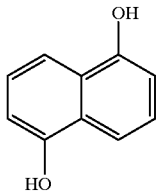 |
| 14 | 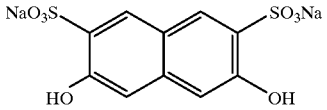 |
| 15 | 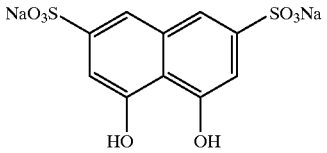 |

The invention has been described in detail with particular reference to certain preferred embodiments thereof, but it will be understood that variations and modifications can be effected within the spirit and scope of the invention.

I claim:

1. A process for the manufacturing of a silver halide element comprising (a) a silver halide emulsion-making step to prepare a silver halide emulsion, (b) a chemical or optical sensitization step, and (c) a coating step, characterized in that said process further comprises the step of adding to said silver halide emulsion, after said chemical or optical sensitization step and before said coating step, an aryl compound having at least two substituents in an amount of less than 0.03 moles per mole of silver, wherein said aryl compound is represented by the following formula (1) or (2):

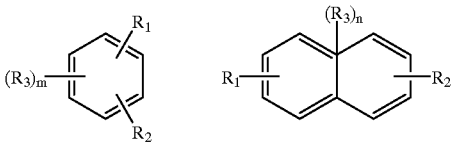

wherein each of $R_1$ and $R_2$ is selected from the group consisting of hydroxyl group and sulfonic group, $R_3$ represents a hydroxyl group, a sulfonic group a nitro group, a cyano group, an amino group, an alkyl group, an alkylcarboxy group, and a carboxyl group, m is an integer of from 1 to 4, and n is an integer of from 1 to 6, provided that when said aryl compound is a 1,2-dihydroxybenzene compound, it further comprises at least one additional substituent other than a sulfo group, and further provided that said silver halide emulsion contains no alkynylamine compound and no polyalkylene glycol.

2. The process according to claim 1, wherein said aryl compound is added in an amount of from 0.0001 to 0.03 moles per mole of silver.

3. The process according to claim 1, wherein said aryl compound is added in an amount of from 0.005 to 0.03 moles per mole of silver.

4. The process according to claim 1, wherein said silver halide emulsion is a tabular grain silver halide emulsion having an aspect ratio of at least 2:1.

5. A silver halide photographic material comprising a support base having coated thereon at least one silver halide emulsion layer, characterized in that said silver halide emulsion layer comprises an aryl compound having at least two substituents in an amount of less than 0.03 moles per mole of silver, wherein said aryl compound is represented by the following formula (1) or (2):

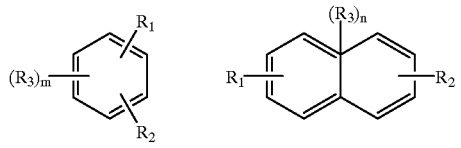

wherein each of $R_1$ and $R_2$ is selected from the group consisting of hydroxyl group and sulfonic group, $R_3$ represents a hydroxyl group, a sulfonic group a nitro group, a cyano group, an amino group, an alkyl group, an alkylcarboxy group, and a carboxyl group, m is an integer of from 1 to 4, and n is an integer of from 1 to 6, provided that when said aryl compound is a 1,2-dihydroxybenzene compound, it further comprises at least one additional substituent other than a sulfo group, and further provided that said silver halide emulsion contains no alkynylamine compound and no polyalkylene glycol.

6. The silver halide photographic material according to claim 5, wherein said silver halide emulsion is a tabular grain silver halide emulsion having an aspect ratio of at least 2:1.

7. The silver halide material of claim 5 wherein said silver halide emulsion layer comprises tabular silver iodobromide grains having from about 0.2 to about 5 mol % iodide based on total silver.

8. The silver halide material of claim 5 wherein said aryl compound is selected from the group consisting of:

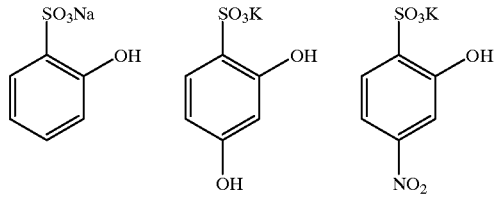

-continued
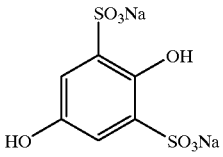
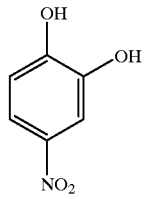
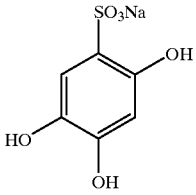
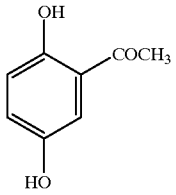
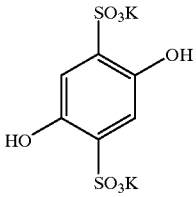
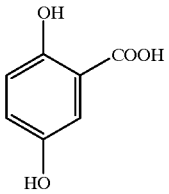
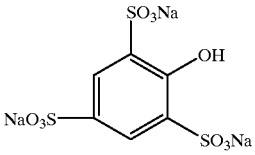
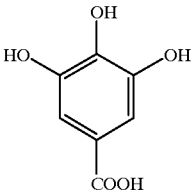
-continued
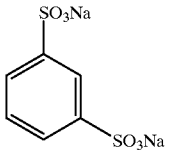
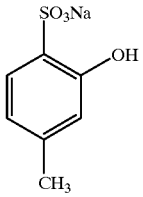
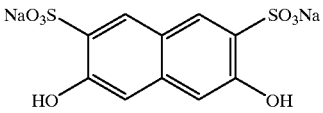
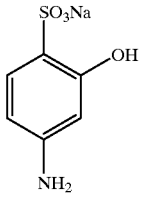
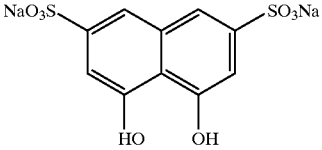
and
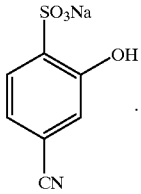
.
* * * * *